US008408966B2

(12) United States Patent
Pei

(10) Patent No.: US 8,408,966 B2
(45) Date of Patent: Apr. 2, 2013

(54) GLASS MANUFACTURING DEVICE

(75) Inventor: Shao-Kai Pei, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 288 days.

(21) Appl. No.: 12/940,038

(22) Filed: Nov. 4, 2010

(65) Prior Publication Data

US 2012/0088437 A1 Apr. 12, 2012

(30) Foreign Application Priority Data

Oct. 12, 2010 (TW) ..... 99134651 A

(51) Int. Cl.
*B24B 49/00* (2006.01)

(52) U.S. Cl. ..... 451/6; 451/11; 451/29; 451/89; 451/102

(58) Field of Classification Search ..... 451/2, 5, 451/9, 10, 11, 29, 38, 41, 75, 80, 89, 90, 451/102

See application file for complete search history.

(56) References Cited

U.S. PATENT DOCUMENTS

| | | | | |
|---|---|---|---|---|
| 5,052,155 | A * | 10/1991 | Blacka et al. | 451/78 |
| 5,195,279 | A * | 3/1993 | Wern | 451/2 |
| 5,490,807 | A * | 2/1996 | Marchell | 451/3 |
| 6,422,920 | B1 * | 7/2002 | Bouten et al. | 451/29 |
| 7,121,925 | B2 * | 10/2006 | Hashimura et al. | 451/29 |
| 7,586,047 | B2 * | 9/2009 | Hayashi et al. | 174/266 |
| RE42,405 | E * | 5/2011 | Fujinaga et al. | 313/582 |
| 2003/0008598 | A1 * | 1/2003 | Jimbo et al. | 451/38 |
| 2003/0121511 | A1 * | 7/2003 | Hashimura et al. | 125/2 |
| 2006/0137173 | A1 * | 6/2006 | Dunn et al. | 29/600 |
| 2011/0126876 | A1 * | 6/2011 | Guo et al. | 136/244 |

* cited by examiner

*Primary Examiner* — Eileen P. Morgan
(74) *Attorney, Agent, or Firm* — Altis Law Group, Inc.

(57) ABSTRACT

A glass manufacturing device includes a work container, a loading device, a sandblaster, a shield device, and a lift device. The loading device is received in the work container and loads a glass substrate in place. The sandblaster is arranged opposite to the loading device and sandblasts the glass substrate. The lift device is connected to the shield device and used for pressing the shield device onto the glass substrate during the process of sandblasting. The shield device includes a shield cover having a number of shield units. The surfaces of the shield units facing the bottom of the work container are engaged with elastic washers. The shield units are configured to shield portions of the glass substrate and prevent the portions of the glass substrate from being cut during sandblasting.

7 Claims, 6 Drawing Sheets

GLASS MANUFACTURING DEVICE

BACKGROUND

1. Technical Field

The present disclosure relates to a glass manufacturing device.

2. Description of Related Art

Methods for manufacturing glass workpieces often include the following steps: cutting a glass substrate into a number of preforms having a same size and shape; gluing the preforms together using ultraviolet (UV) glue; grinding edges of the preforms to obtain the workpieces; then removing the UV glue to separate the workpieces, which is complicated and time-consuming.

Therefore, it is desirable to provide a glass manufacturing device that can overcome the above-mentioned limitations.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
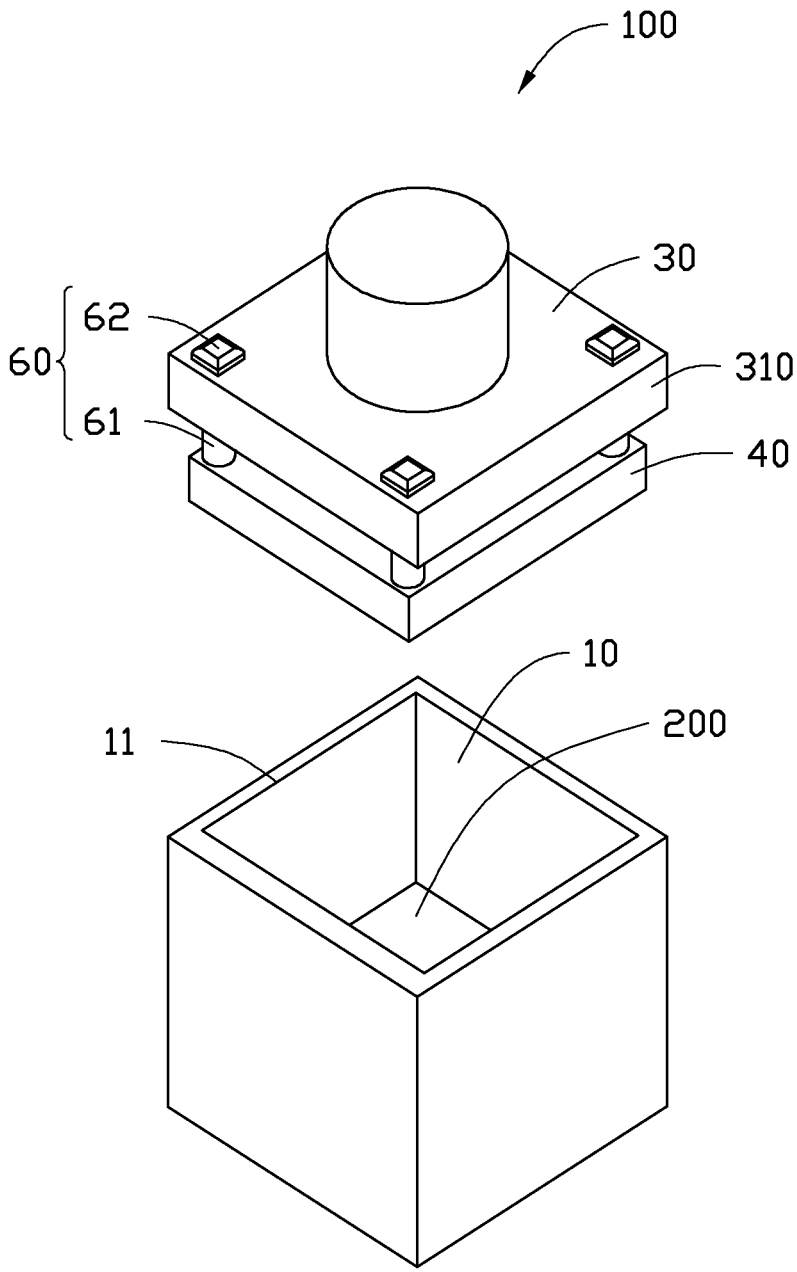
FIG. 1 is an exploded view of a glass manufacturing device, according to an exemplary embodiment.
Figure 2:
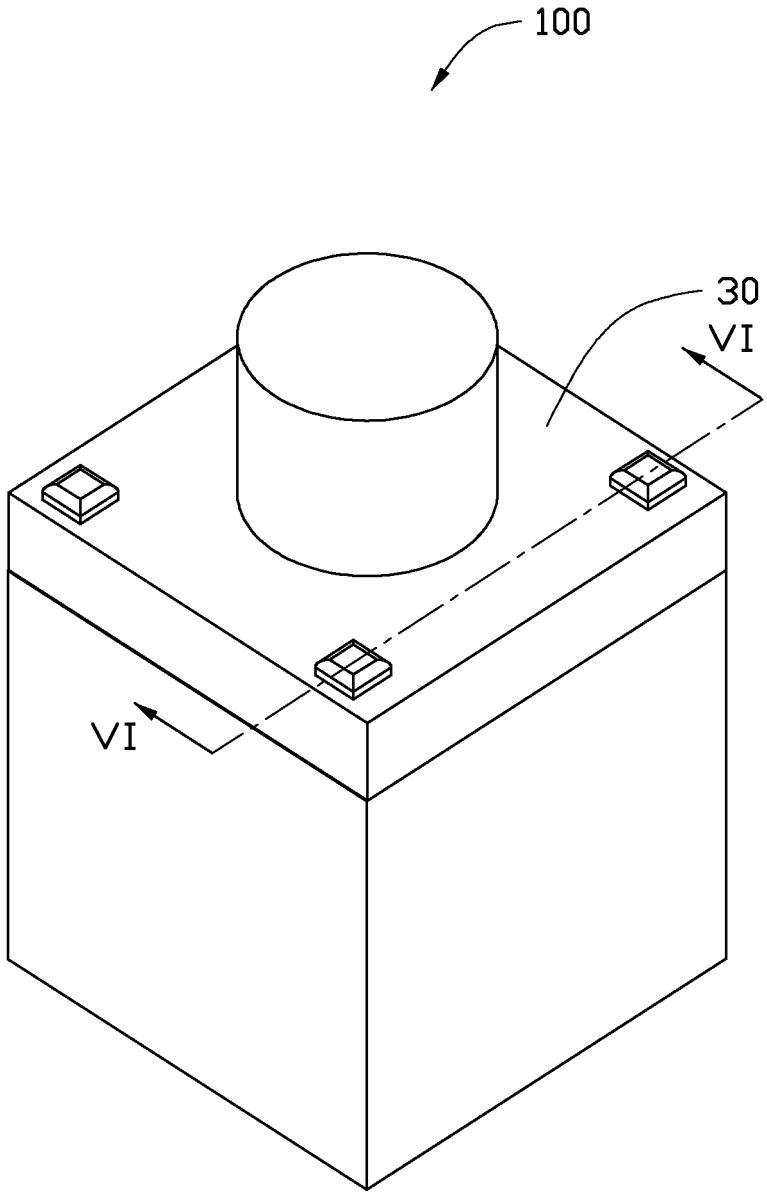
FIG. 2 is a schematic view of the glass manufacturing device of FIG. 1.
Figure 3:
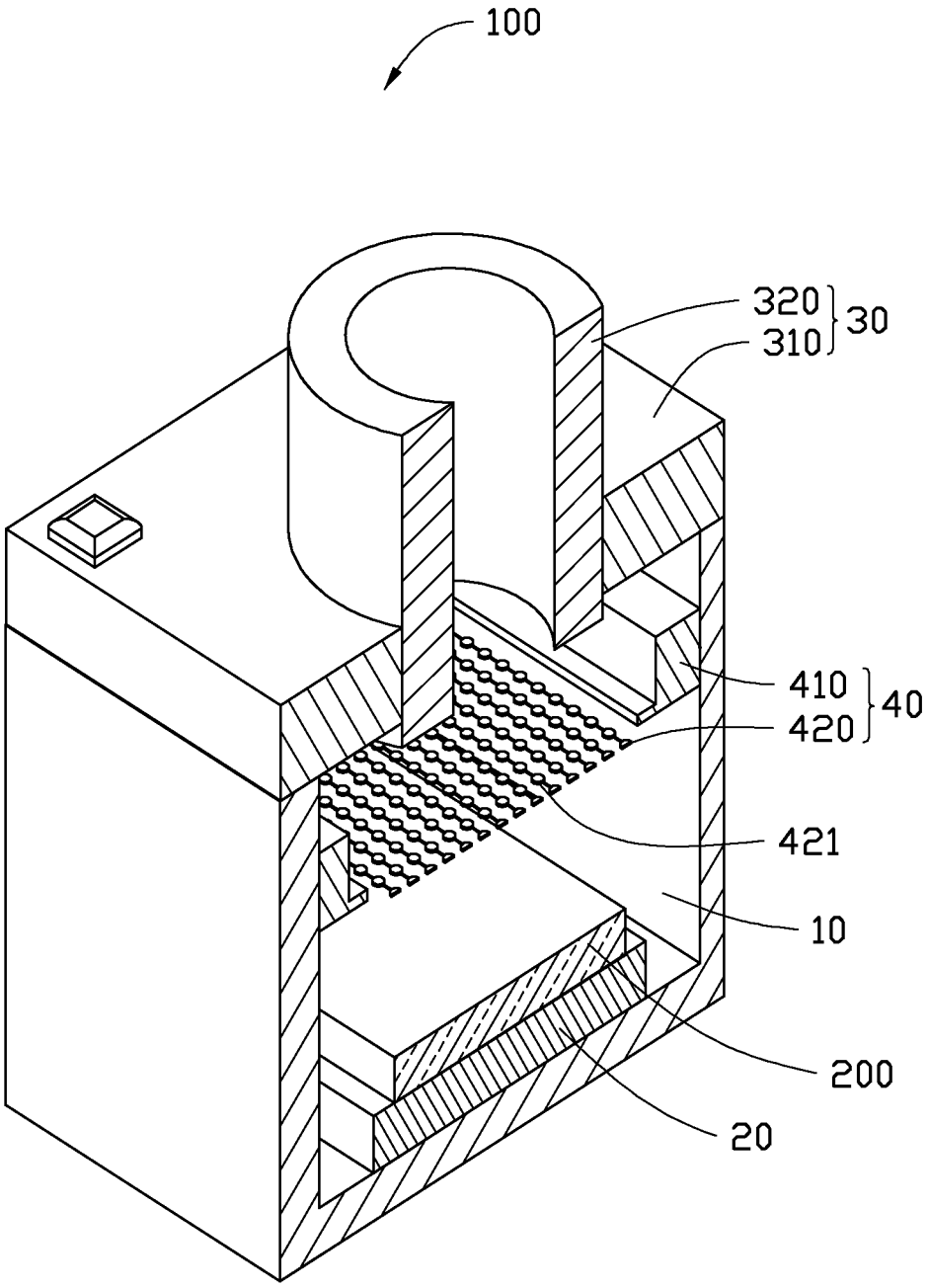
FIG. 3 is a cross-sectional view of the glass manufacturing device of FIG. 1.
Figure 6:
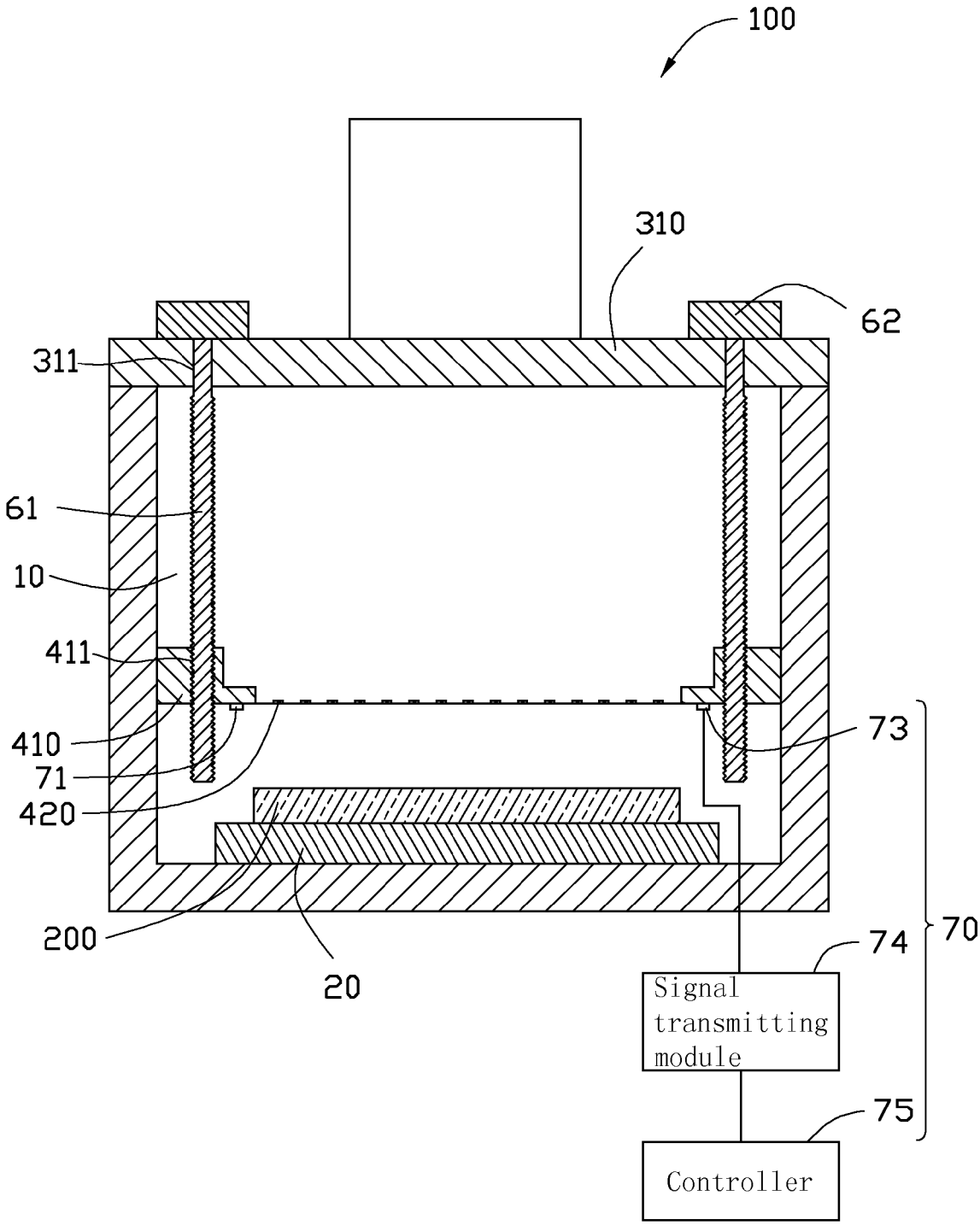
FIG. 6 is another cross-sectional view of the glass manufacturing device, taken along a line VI-VI of FIG. 2.

Referring to FIGS. 1-3, a glass manufacturing device 100, according to an exemplary embodiment, includes a work container 10, a loading device 20, a sandblaster 30, a shield device 40, a lift device 60, and a control device 70 (shown in FIG. 6).

The work container 10 is substantially cuboid and defines a rectangular opening 11 for receiving the loading device 20, the shield device 40, and the lift device 60 therein.

The loading device 20 is arranged on the bottom of the work container 10 and supports a glass substrate 200. In this embodiment, the glass substrate 200 is rectangular. In other embodiments, the glass substrate 200 can be other shapes (e.g. circular or triangular).

The sandblaster 30 includes a fixing plate 310 and a jet 320. The fixing plate 310 is used for substantially hermetically sealing the opening 11. The jet 320 perpendicularly extends through the top and bottom surfaces of the fixing plate 310 and into the work container 10. The jet 320 can sandblast the glass substrate 200 to cut the glass substrate 200 into a number of glass products. In this embodiment, the fixing plate 310 is rectangular, corresponding to the shape of the opening 11.

Figure 4:
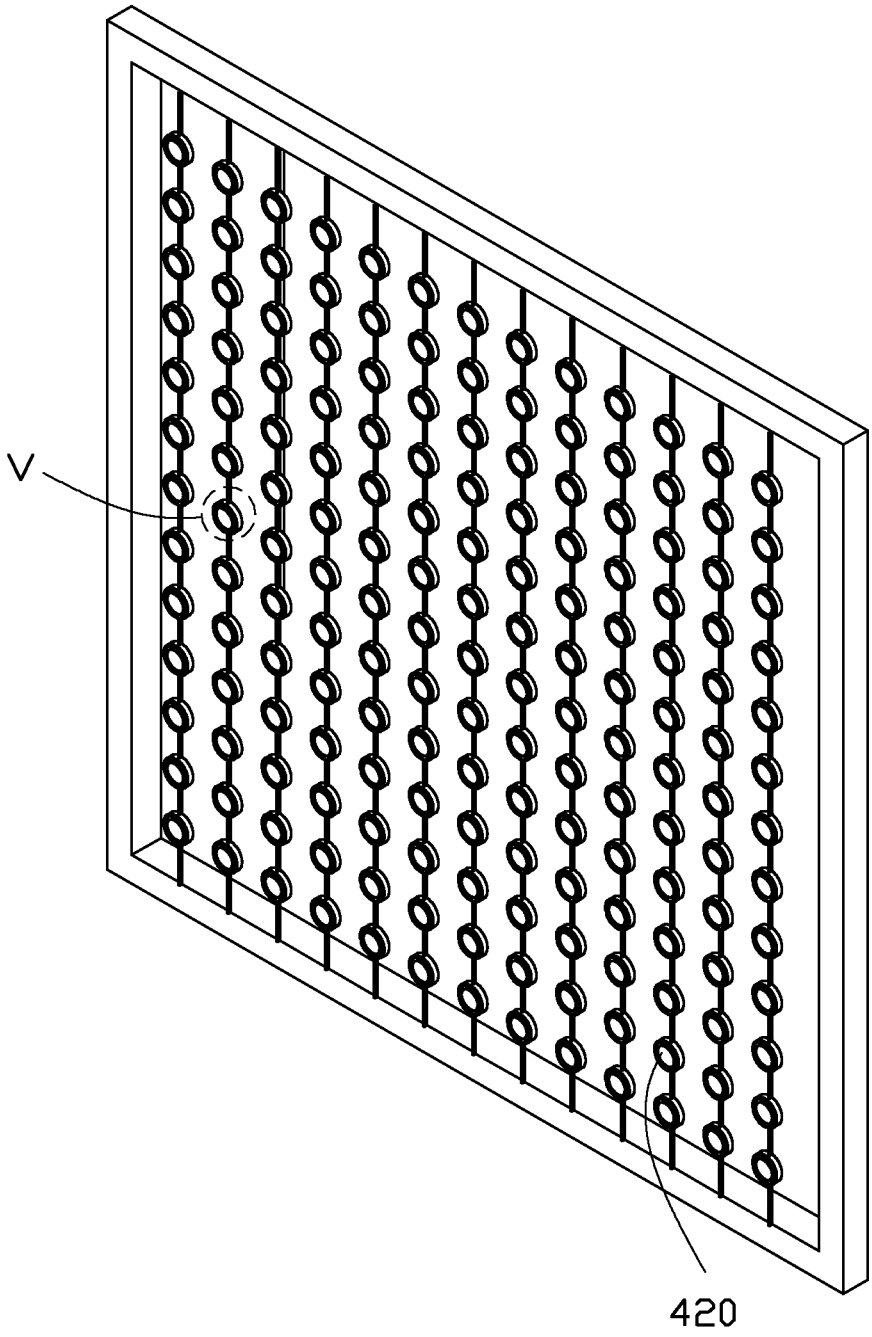
FIG. 4 is a schematic view of a shield cover of the glass manufacturing device of FIG. 1.
Figure 5:
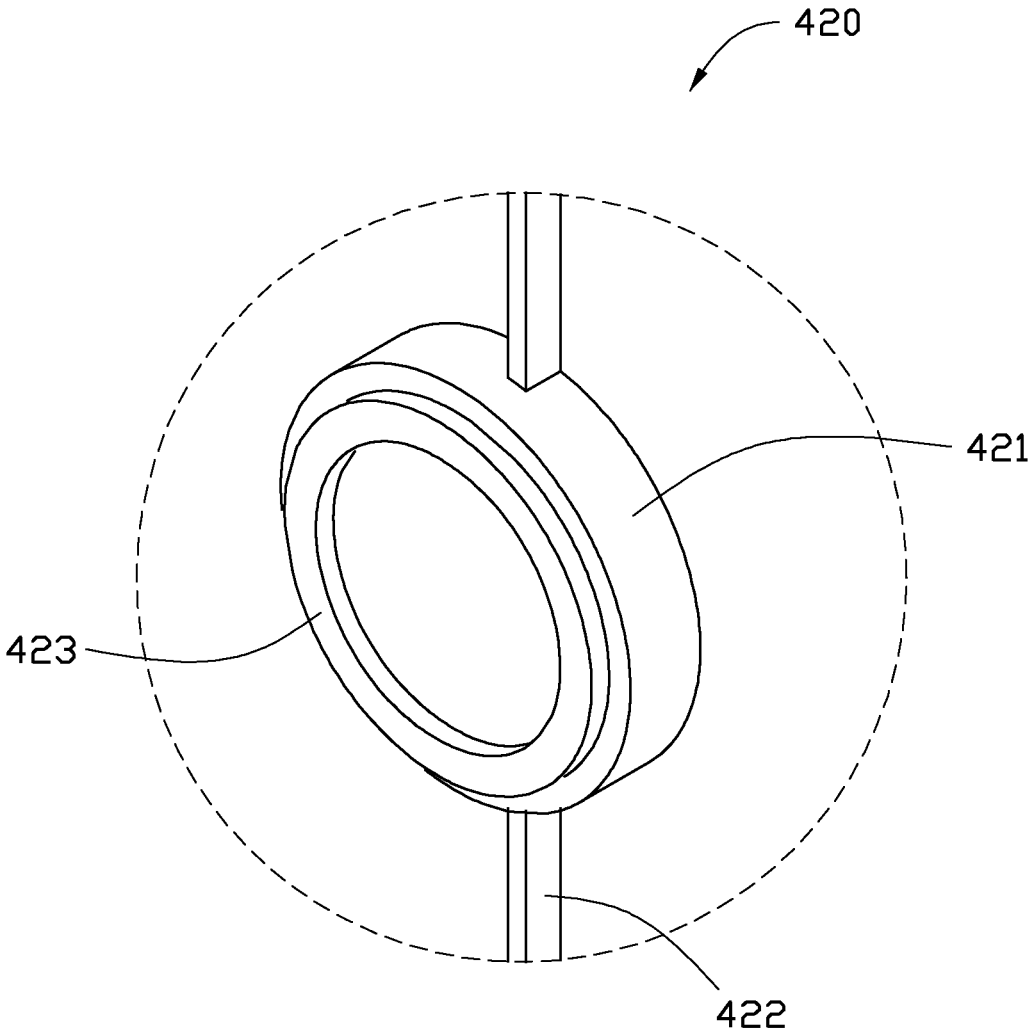
FIG. 5 is an enlarged view of a circled part V of FIG. 4.

The shield device 40 is received in the opening 11, and is substantially parallel and is arranged between the fixing plate 310 and the loading device 20. The shield device 40 includes a fixing frame 410 and a shield cover 420 fixed on the fixing frame 410. The area of the fixing frame 410 is slightly smaller than that of the opening 11, thus the shield cover 420 can be fittingly inserted into the work container 10, and abut against the inner sidewall of the work container 10. The shield cover 420 is made of rigid metal (e.g. iron), thus is resistant to the effects of the sandblasting and will last a long time through many uses. Therefore, the shield cover 420 can shield the glass substrate 200, while the sandblasting in predetermined patterns quickly cuts it. Also referring to FIGS. 4 and 5, the shield cover 420 includes a number of shield units 421. In this embodiment, the shield units 421 are arranged in an array. Each shield unit 421 is circular. In other embodiments, the shield units 421 can be arranged in other manners and be some other shape, according to user's need.

Thin connection poles 422 connect the shield units 421 to each other. The shield units 421 are thicker than the connection poles 422. The shield units 421 project towards the glass substrate 200 relative to the connection poles 422. Thus, when the shield units 421 press onto the glass substrate 200, the connection poles 422 will not contact with the glass substrate 200, and portions of the glass substrate 200 below the connection poles 422 can be cut away.

In order that the shield units 421 can press onto the glass substrate 200 firmly without harming the glass substrate 200, the surface of each shield unit 421 facing the bottom of the work container 10 is engaged with an elastic washer 423. The elastic washer 423 is slightly smaller than the shield unit 421 is mounted on the shield unit 421 by glue or insertion.

Also referring to FIG. 6, the lift device 60 includes four support poles 61 positioned at four corners of the fixing plate 310 and four elevator motors 62. The fixing plate 310 defines four first though-holes 311. One end of each support pole 61 extends through a corresponding first through-hole 311 and couples to a rotor of the corresponding elevator motor 62, therefore, each elevator motor 62 can drive the corresponding support pole 61 to rotate. The other end of each support pole 61 is threaded. The fixing frame 410 defines four second threaded through-holes 411 for engaging with the threaded ends of the poles 61, thus the fixing frame 410 can be moved upwards or downwards along a direction perpendicular to the loading device 20. The lift device 60 supports the shield cover 420 and presses the shield cover 420 on the glass substrate 200 during the process of sandblasting.

The control device 70 includes a pair of sensors 71 and 73, a signal transmitting module 74, and a controller 75. The sensors 71 and 73 sense whether the shield units 421 are contacted with the glass substrate 200. In this embodiment, the sensors 71 and 73 are optical sensors. The sensor 71 is a light emitter, and the sensor 73 is a light receiver. The light emitter 71 and the light receiver 73 are respectively mounted on two opposite sides of the fixing frame 410 facing the glass substrate 200. When the shield device 40 does not press onto the glass substrate 200 the light signals emitted by the light emitter 71 reach the light receiver 73 without attenuation. When the shield device 40 presses onto the glass substrate 200 the light signals emitted by the light emitter 71 are blocked or are reduced by the glass substrate 200, thus light signals reach the light receiver 73 with attenuation. The light receiver 73 senses the light intensity of the reached light signals and send out sensor signals to the signal transmitting module 74. The signal transmitting module 74 is used for transmitting the sensor signals to the controller 75. In this embodiment, the signal transmitting module 74 is a BLUETOOTH transmitting module or a Wi-Fi transmitting module. The controller 75 receives the sensor signals, converts the sensor signals to a light intensity value. The controller 75 stores a predetermined value and compares the light intensity value with the predetermined value and controls the elevator motors 62 to rotate according to the comparison result. When the light intensity value is equal to or smaller than the predetermined value, the controller 75 controls the elevator motor 62 to stop working and the fixing frame 410 stops moving downwards to prevent damage to the glass substrate 200. Therefore, the control device 70 can control the lift height of the shield device 40 according to the thickness of the glass substrate 200. In other embodiments, the four support poles 61 also can be fixed on other locations of the fixing plate 310. The number of the support poles 61 is not limited to this embodiment.

In other embodiments, if a user only wants to manufacture the glass substrate 200 having a same thickness, the control device can be omitted. Two ends of each support pole 61 can be respectively fixed onto the fixing frame 410 and the fixing plate 310 to press the shield units 421 on the glass substrate 200.

In use, the glass substrate 200 is fixed onto the loading device 20. The fixing plate 310 substantially hermetically seals the opening 11. The elevator motors 62 respectively drive the corresponding support poles 61, to make the shield units 421 move downwards to press onto the glass substrate 200 firmly through the engagement of the support poles 61 with the second threaded through holes 411. The sandblaster 30 blasts sand from the jet 320 onto the glass substrate 200 until the portions of the glass substrate 200 not shielded by the shield units 421 are cut by the sand. The elevator motors 62 respectively drive the corresponding support poles 61 to move upwards. The remaining portions of the glass substrate 200, which were shielded by the shield units 421, can then be used. The area of each piece of glass is equal to the corresponding shield unit 421. It can be understood that the area of the shield units 421 can be adjusted according to need.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A glass manufacturing device, comprising:

a work container having an opening;

a loading device received in the work container and configured for supporting a glass substrate;

a sandblaster opposite to the loading device, the sandblaster comprising a fixing plate and a jet, the fixing plate covering the opening and defining at least one first through-holes, the jet perpendicularly extending through a top surface and a bottom surface of the fixing plate and communicating with the work container, the jet configured to blast sands onto the glass substrate to cut the glass substrate;

a shield device movably received in the work container and arranged between the loading device and the sandblaster, the shield device comprising a shield cover and a fixing frame fixing the shield cover, the area of the fixing frame slightly smaller than that of the opening, the fixing frame defining at least one second threaded through-hole, the shield cover having a plurality of shield units, the shield units configured for shielding portions of the glass substrate and preventing the portions of the glass substrate from being cut during the process of sandblasting, wherein the surface of each shield unit facing the bottom of the work container is engaged with an elastic washer;

a lift device received in the work container, the lift device configured for pressing the shield device on the glass substrate during the process of sandblasting, the lift device comprising at least one support pole and at least one elevator motor, one end of the at least one support pole inserting through the at least one first through-hole and coupling to the at least one elevator motor, the other end of the at least one support pole being threaded and engaging with the at least one second threaded through-hole; and a control device configured for controlling the lift device to carry the shield device to move relative to the loading device.

2. The glass manufacturing device of claim 1, wherein the control device comprises a light emitter, a light receiver, a signal transmitting module, and a controller; the light emitter is configured for emitting out a light signal, the light signal is blocked by the glass substrate and thus is attenuated when the shield units are contacted with the glass substrate, the light receiver senses the light intensity of the light signal and converting the light intensity value to a sensor signal; the signal transmitting module is configured for transmitting the sensor signal to the controller; the controller is configured for converting the sensor signal to a light intensity value, and then comparing the light intensity value with a predetermined value, and controlling the at least one elevator motor according to a comparison result.

3. The glass manufacturing device of claim 2, wherein the light emitter and the light receiver are positioned on two opposite sides of the fixing frame and face the loading device.

4. The glass manufacturing device of claim 2, wherein the signal transmitting module is selected from the group consisting of a BLUETOOTH transmitting module and a Wi-Fi transmitting module.

5. The glass manufacturing device of claim 1, wherein the shield cover is made of rigid metal.

6. The glass manufacturing device of claim 1, wherein the shield units is arranged in an array.

7. The glass manufacturing device of claim 1, wherein the shield device further comprises a plurality of connection poles, each connection pole connects the corresponding shield units, the shield units project towards the loading device relative to the connection poles.

* * * * *